US006550144B1

(12) United States Patent
Berns

(10) Patent No.: US 6,550,144 B1
(45) Date of Patent: Apr. 22, 2003

(54) HOLLOW-HANDLE RAZOR KNIFE WITH BLADE SLIDE

(76) Inventor: Harald Berns, Kronprinzenallee 127, D-42119 Wuppertal (DE)

( * ) Notice: Subject to any disclaimer, the term of this patent is extended or adjusted under 35 U.S.C. 154(b) by 0 days.

(21) Appl. No.: 09/535,481

(22) Filed: Mar. 24, 2000

(30) Foreign Application Priority Data

Apr. 9, 1999 (DE) ..... 199 15 934

(51) Int. Cl.[7] ..... B26B 1/08; B26B 5/00

(52) U.S. Cl. ..... 30/162; 30/320; 30/335; 30/339

(58) Field of Search ..... 30/2, 162, 163, 30/335, 336, 337, 338, 339, 320, 151, 164, 286, 289, 294, 329, 332, 333, 342

(56) References Cited

U.S. PATENT DOCUMENTS

| | | | | | |
|---|---|---|---|---|---|
| 3,708,881 | A | | 1/1973 | Bennett | 30/320 |
| 3,879,847 | A | * | 4/1975 | Roll | 30/162 |
| 3,999,290 | A | * | 12/1976 | Wood | 30/2 |
| 4,744,146 | A | * | 5/1988 | Schmidt | 30/162 |
| 4,835,865 | A | | 6/1989 | Knoop | 30/162 |
| 4,939,839 | A | * | 7/1990 | Gorst | 30/162 X |
| 5,330,493 | A | * | 7/1994 | Haining | 30/335 X |
| 5,344,424 | A | * | 9/1994 | Roberts et al. | 30/162 X |
| 5,613,300 | A | * | 3/1997 | Schmidt | 30/162 X |
| 5,644,843 | A | * | 7/1997 | Young | 30/162 X |
| 5,662,669 | A | * | 9/1997 | Abidin et al. | 30/151 X |
| 6,148,520 | A | * | 11/2000 | Berns | 30/2 |
| 6,161,290 | A | * | 12/2000 | Takamasa | 30/162 |

FOREIGN PATENT DOCUMENTS

EP 0 244 517 * 11/1987

* cited by examiner

*Primary Examiner*—Clark F. Dexter
(74) *Attorney, Agent, or Firm*—Herbert Dubno; Andrew Wilford

(57) ABSTRACT

A razor-knife housing has a neat part retaining a blade and displaceable in the housing through a front-end slot between an extended position with the blade mainly outside the housing and a retracted position with the blade wholly inside the housing. A retaining part in slidable on the seat part between a closed position overlying the blade and holding it on the seat part and an open position exposing the blade on the formation and allowing it to be removed therefrom. The parts have faces normally engageable with each other to prevent sliding of the retaining part on the seat part. One of the faces is displaceable transversely to the other to allow the parts to slide relative to each other. In the extended position of the seat part and open position of the retaining part, the blade is is not retained on the seat part by the retaining part.

11 Claims, 4 Drawing Sheets

HOLLOW-HANDLE RAZOR KNIFE WITH BLADE SLIDE

FIELD OF THE INVENTION

The present invention relates to a razor knife. More particularly this invention concerns such a knife with a hollow handle holding a slide displaceable between a use position with the blade projecting from the handle and a storage position with the blade retracted into the handle.

BACKGROUND OF THE INVENTION

A standard utility knife as described in U.S. Pat. No. 4,835,865 of H. Knoop has a hollow handle provided with a blade-carrying slide displaceable between advanced and retracted positions. A return spring urges the slide back into the retracted position. The blade is held on pins projecting transversely from the slide and a retaining element hinged on the slide normally fits with the pins over the blade to hold it in place. The knife body has a main part carrying the slide and another part that can be removed to expose the retaining element and allow it to be swung out for removal and replacement of the blade. Such a knife is handy, but is normally set up for only one type of blade due to the type of holder, that is it can use standard trapezoidal disposable blades or square single-edge blades, but not both.

U.S. Pat. No. 3,708,881 of R. Bennett describes another slide-type razor knife where the slide is displaceable past the normal use position into a fully extended position in which the blade is fully exposed and can be lifted off the slide and into a full-rear position in which a blade magazine on the rear end of the slide is exposed. Thus to change blades the slide is first retracted fully to allow a fresh blade to be extracted from the supply in the magazine and then is advanced fully to allow the old blade to be removed and the new blade to be installed in place. This system has the disadvantage that, for instance, when cutting by drawing the knife back it is possible to accidentally shift into the fully extended position and have the blade fall off the slide.

OBJECTS OF THE INVENTION

It is therefore an object of the present invention to provide an improved hollow-handle razor knife.

Another object is the provision of such an improved hollow-handle razor knife which overcomes the above-given disadvantages, that is which can use different types of blades and that securely holds its blade regardless of the type of cutting.

SUMMARY OF THE INVENTION

A razor knife has according to the invention a hollow elongated housing having a front end slot and a slide seat part having a formation adapted to retain a blade and displaceable longitudinally in the housing through the slot between a longitudinally forwardly extended position with the blade retained on the formation lying mainly outside the housing and a longitudinally rearwardly retracted position with the blade retained on the formation wholly inside the housing. A retaining part is slidable on the seat part in a direction between a closed position overlying the blade and holding it in place on the seat part and an open position exposing the blade on the formation and allowing it to be removed therefrom. The parts have stop faces engageable with each other in the direction to prevent sliding of the retaining part on the seat part in the direction. One of the stop faces is displaceable transversely to the other to allow the parts to slide relative to each other in the direction. In the extended position of the seat part and open position of the retaining part the blade is exposed outside the housing and is not retained in place on the seat part by the retaining part.

Thus with this system the blade is changed by advancing the slide part while holding back the retaining part so that the slide part ends up projecting from the housing with the blade on it ready to be picked off and replaced. When the slide part is returned back into the housing it latches at the stop faces with the retaining part so that the two thereafter move together, holding the blade solidly as it is moved into and out of the housing.

According to the invention the direction of relative translatory movement of the slide parts is longitudinal so that the retaining part moves on the seat part in the same direction as the slide moves in the housing. More particularly one of the parts is formed with a longitudinally extending guide on which the other of the parts can slide. In the extended position of the seat part and closed position of the retaining part both parts project through the slot.

The retaining part according to the invention engages around the seat part. Specifically, the retaining part is of C-section and forms a pair of guide grooves and the seat part has edge ribs slidable in the grooves. Furthermore, each of the parts has a respective rearward extension. The extensions form the stop faces and one of the extensions is elastically transversely deformable to move the stop faces from a position longitudinally aligned with each other to a position longitudinally out of alignment with each other. Further cam formations on the extensions allow them to deflect as the retaining part is moved from the open to the closed position, whereupon the stop faces latch together and hold the parts in this position.

The one extension is formed with an actuating button that may be accessible through a port in the side of the housing. Alternately the housing has a pair of parts movable between a closed position encasing the slide and an open position exposing the slide so that the retaining part can only be unlatched and slid on the seat part when the housing is open.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
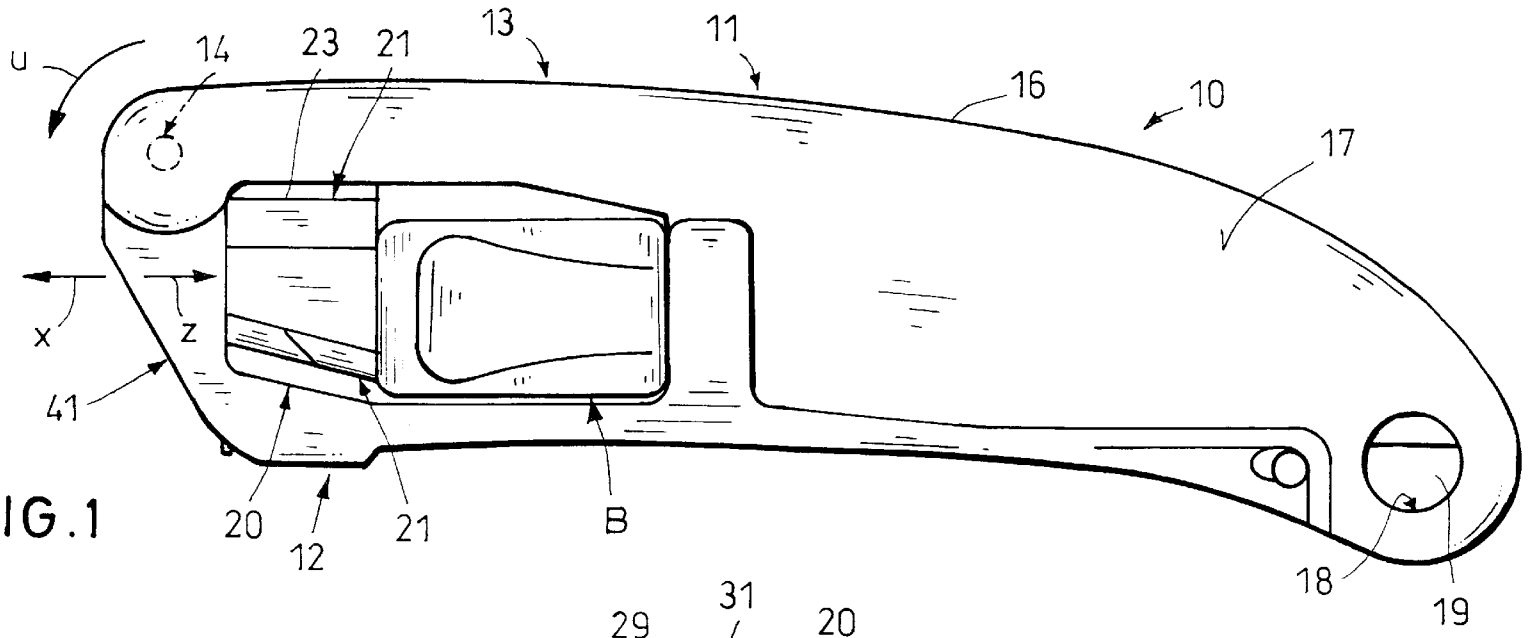
FIG. 1 is a side view of the knife in the retracted/storage position.

As seen in FIGS. 1 to 4 a razor knife 10 according to the invention has a body or housing 11 formed by a base half 12 and a cover half 13. A pivot pin 14 on the front end of the cover 13 fits into a hole 15 on the base 12 to allow the cover 13 to pivot as shown by arrow u from the closed position of FIG. 1 to an open position. The two housing halves 12 and 13 together define an elongated chamber 17 holding the moving parts of the knife and having a curved back edge 16 generally parallel to a longitudinal axis of the housing 11. A hole 18 at the rear end of the base 12 and cover 12 accommodates a spring-loaded pin or button 19 in the base 12 that normally projects into the cover 13 so as to hold the two parts 12 and 13 together. When the button 19 is depressed the cover 13 can be pivoted into the open position in which virtually the entire blade 20 is outside the housing 11.

A standard square single-edge blade 20 in the cavity 17 is held in the slide 21 movable outward (arrow x) and inward (arrow z) and comprised of a seat or holder part 22 and a retaining part 23. The blade 20 is held in a complementary seat 24 of the part 22 by formations 25A and 25B of the retaining part 23. Two pins 26 on the part 22 fit in holes 27 of the blade so it cannot normally move relative to the slide 21 in the plane of the seat surface 24, with the retaining part 23 preventing it from lifting out of the seat 24. A front corner 28 of the blade 20 projects from the slide 21 and from a slot 41 in the front end of the housing 11 in the use or extended position. An actuating mechanism B not described in further detail projects through the cover part 13 and moves the slide 21 with the blade 20 back and forth between its end positions. A spring 37 has a front end 38 hooked on the slide 21 and a rear end 39 hooked on the housing 11 to urge the slide 21 and blade 20 into the rear retracted position.

Figure 4:
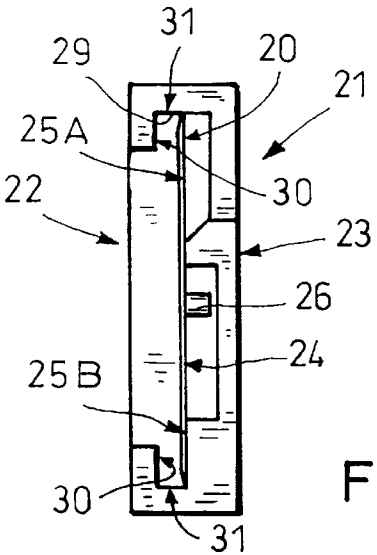
FIG. 4 is an end view of the slide taken in the direction of arrow IV of FIG. 2.
Figure 2:
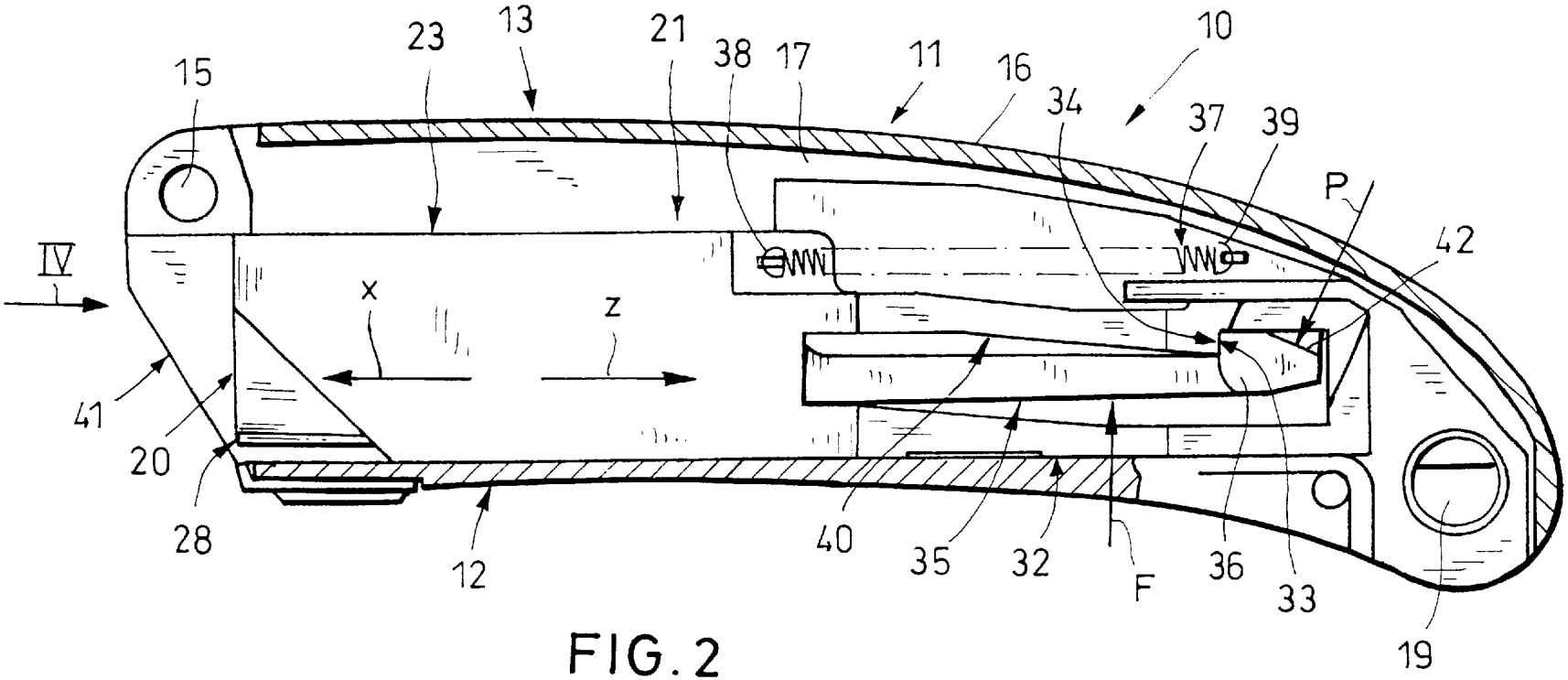
FIG. 2 is a view like FIG. 1 but in longitudinal section.

As shown in FIG. 4 the retaining part 23 is of C-section and forms a guide space 29 in which the T-section seat part 22 can slide longitudinally, that is parallel to directions x and y. More specifically the space 29 forms a pair of tracks or guides 30 in which longitudinal ribs 31 of the part 22 are captured and can slide. The retaining part 23 has a rearward extension 32 formed with a rearwardly directed stop or abutment surface 33 engageable with a forwardly directed abutment surface or stop 34 on a button-like rear end 36 of a rearward extension 35 of the seat part 22. Both the parts 22 and 23 are formed of a stiff but elastically deformable synthetic resin such as nylon so that it is possible by pushing transversely as shown by arrow P (FIG. 2) on the end 36 to move the two stop faces 33 and 34 out of engagement with each another. A cam surface 40 formed on the seat-part extension 32 and extending at a very small acute angle to the longitudinal direction is engageable with a similarly inclined surface 42 at the rear end of the extension 35 to cam down the extension 35 as described below. The button/end 36 can be exposed through an aperture or slot in the cover part 13, but normally is covered thereby so as to be accessible only in the open position of the cover part 13.

Normally the two slide parts 22 and 23 fit together with the stop faces 33 and 34 engaging each other in a locked position preventing them from sliding in either direction x or z relative to each other. The rear end 36 is thus captured between the rearward-facing stop face 33 and a forward-facing surface 44 of the extension 32. To use the knife, the actuating button B is slid forward so that the blade 20 along with both parts 22 and 23 of the slide 21 10 move in direction x and the blade corner 28 projects from the housing 11.

Figure 3:
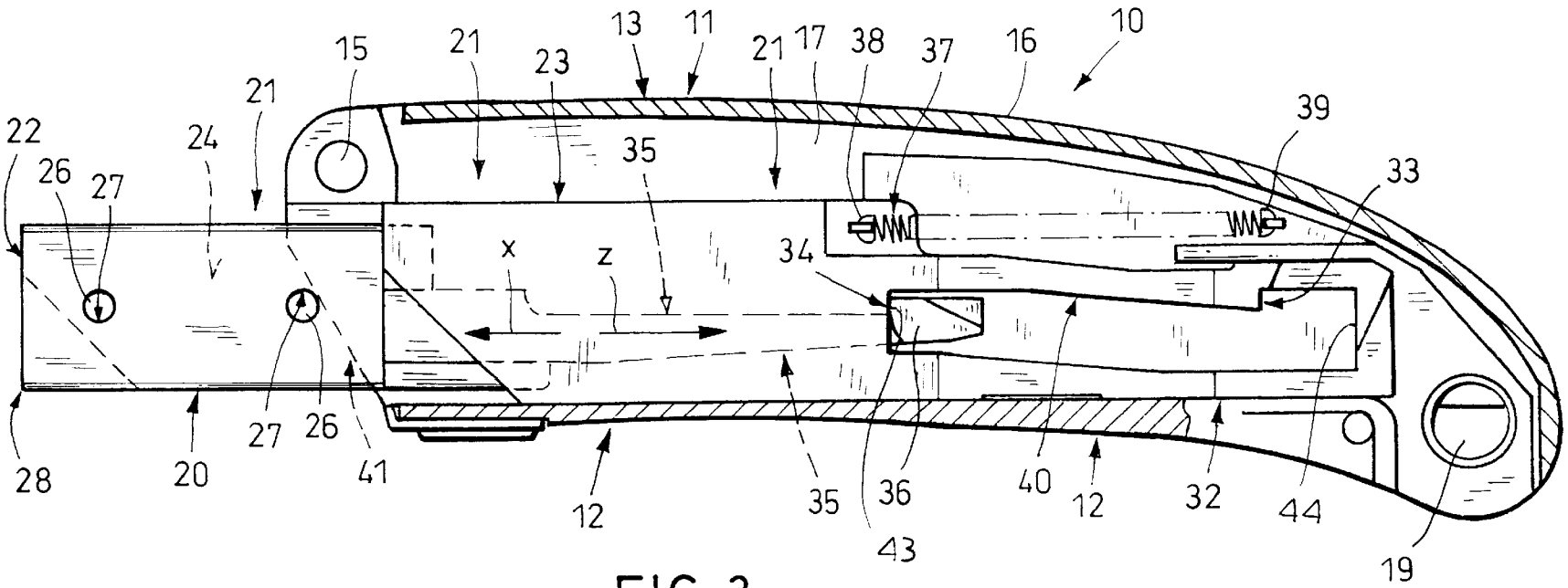
FIG. 3 is a view like FIG. 2 but in the extended/use position.
Figure 5:
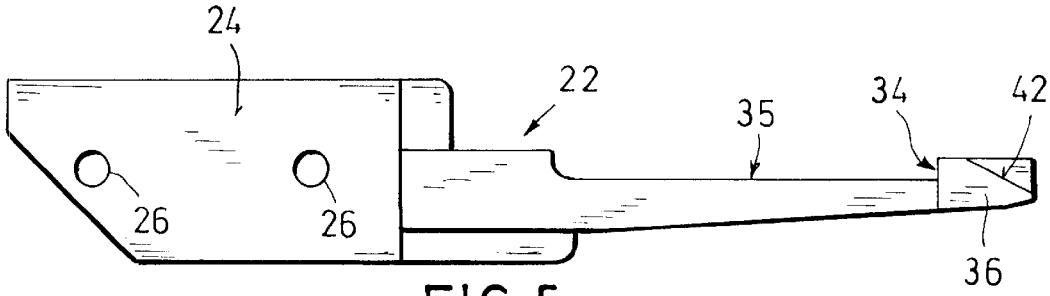
FIGS. 5 and 6 are opposite side views of the seat part of the slide according to the invention.
Figure 6:
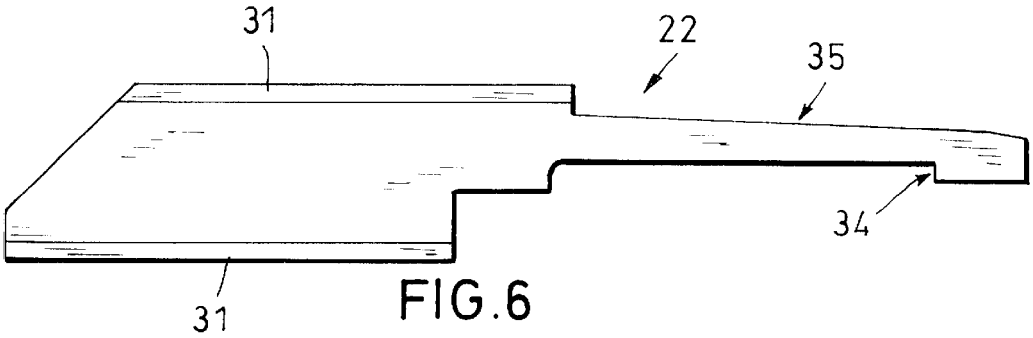
Figure 7:
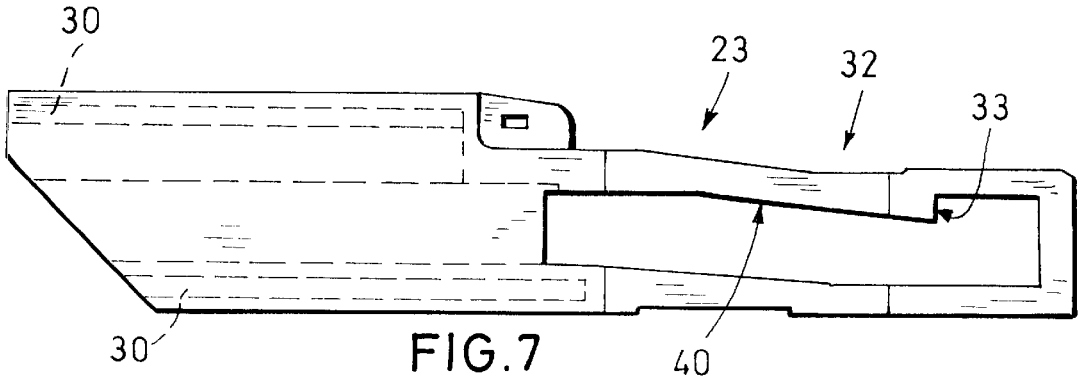
FIGS. 7 and 8 are opposite side views of the cover part of the slide.
Figure 8:
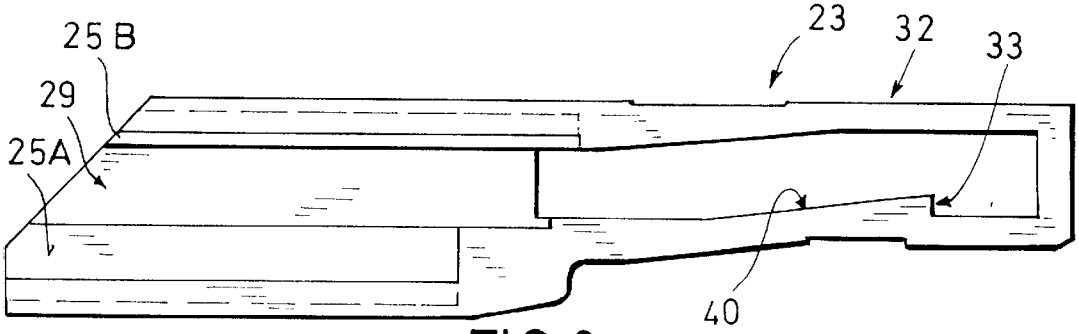

To change the blade 20, the button 19 is depressed and the cover part 13 is swung as shown by arrow u to expose the parts in the cavity 17. Then the extension rear-end 36 is pushed down against its elastic spring force f in direction p into an activated position to disengage the two stop faces 33 and 34 from each other. The seat part 22 of the slide 21 is then slid forward by the actuating button B until the stop face 34 engages a rearwardly facing surface 43 of the retaining part 23. In this position as shown in FIG. 3 virtually the entire blade 20 is exposed outside the slot 41 and can easily be lifted off the pins 26 and replaced with a fresh blade. Then the slide part 22 is slid back in direction z until the stop faces 33 and 34 latch together, the cover 13 is swung back onto the part 12, and the knife 10 is ready to use again, with the fresh blade.

In the unillustrated fully extended position of the slide 21 with the retaining part 23 in the closed position, the blade 20 is held solidly. It will therefore not pull off the slide 20 during cutting when the knife 10 is drawn along the workpiece.

What is claimed is:

1. In combination with a blade, a razor knife comprising:

a hollow elongated housing having a front end slot;

a slide seat part having a formation removably retaining the blade, the seat part being displaceable longitudinally in the housing through the slot between a longitudinally forwardly extended position with the blade retained on the formation lying mainly outside the housing and a longitudinally rearwardly retracted position with the blade retained on the formation wholly inside the housing; and a retaining part slidable on the seat part in a direction between a closed position overlying the blade and holding it in place on the seat part and an open position exposing the blade on the formation and allowing it to be removed therefrom, the parts having stop faces engageable in a locked position with each other to prevent sliding of the retaining part on the seat part in the direction, whereby the retaining part is displaceable together with the slide seat part to the extended and retracted positions, one of the stop faces being displaceable transversely to the other into an actuated position to allow the parts to slide relative to each other in the direction, whereby in the extended position of the seat part and the open position of the retaining part the blade is exposed outside the housing and in not retained in place on the seat part by the retaining part.

2. The razor knife defined in claim 1 wherein the direction in longitudinal, whereby the retaining part moves on the seat part in the same direction as the slide seat part moves in the housing.

3. The razor knife defined in claim 2 wherein one of the parts is formed with a longitudinally extending guide on which the other of the parts is slidable.

4. The razor knife defined in claim 3 wherein in the extended position of the seat part and closed position of the retaining part both parts project through the slot.

5. The razor knife defined in claim 3 wherein the retaining part engages around the seat part.

6. The razor knife defined in claim 5 wherein the retaining part is of C-section and forms a pair of guide grooves and the seat part has edge ribs slidable in the grooves.

7. The razor knife defined in claim 2 wherein each of the parts has a respective rearward extension, the extensions forming the faces, one of the extensions being elastically transversely deformable to transversely shift the respective face from a position longitudinally aligned with the face of the other extension to a position with the faces longitudinally out of alignment.

8. The razor knife defined in claim 7 wherein the one extension is formed with an actuating button.

9. The razor knife defined in claim 1 wherein the housing has a pair of parts movable between a closed position encasing the slide and an open position exposing the slide.

10. The razor knife defined in claim 1 wherein the formation is a pair of pins engageable through holes in the blade.

11. The razor knife defined in claim 1, further comprising a spring connected to the housing and to one of the parts and urging the one part into the retracted position.

* * * * *